US005865507A

United States Patent [19]

Earl, Jr.

[11] Patent Number: 5,865,507

[45] Date of Patent: Feb. 2, 1999

[54] KNEELER

[76] Inventor: Lionel F. Earl, Jr., 361 Pratt Cir., Montgomery, Ala. 36115

[21] Appl. No.: 879,642

[22] Filed: Jun. 20, 1997

Related U.S. Application Data

[63] Continuation-in-part of Ser. No. 675,544, Jul. 3, 1996, abandoned.

[51] Int. Cl.[6] ..... A47C 16/04

[52] U.S. Cl. ..... 297/423.11; 280/32.6

[58] Field of Search ..... 297/423.11, 423.12; 280/32.6, 7.14, 7.17

[56] References Cited

U.S. PATENT DOCUMENTS

| | | | |
|---|---|---|---|
| 1,408,253 | 2/1922 | Blank | 297/423.11 X |
| 2,318,059 | 5/1943 | Cooper | 280/32.6 X |
| 2,480,406 | 8/1949 | Forney | 297/423.11 X |
| 2,750,198 | 6/1956 | Moore et al. | 280/7.14 |
| 3,863,978 | 2/1975 | Cullings, Jr. | 297/423.11 X |
| 4,772,071 | 9/1988 | Richards | 297/423.12 |

FOREIGN PATENT DOCUMENTS

| | | | |
|---|---|---|---|
| 449588 | 7/1948 | Canada | 297/423.12 |

*Primary Examiner*—Peter R. Brown
*Attorney, Agent, or Firm*—Peter Loffler

[57] ABSTRACT

A kneeler is used by a person for comfortably working while in a kneeling position and is comprised of a generally rectangular base having a pair of coextensive troughs with optional knee wells located at the end thereof. A pair of runners are removably secured to the bottom of the device. A seat is removably secured and selectively positioned onto the device with the optional usage of height-raising risers. An opening is located on the base and acts as a receptacle for objects used while working.

8 Claims, 3 Drawing Sheets

FIG. 4
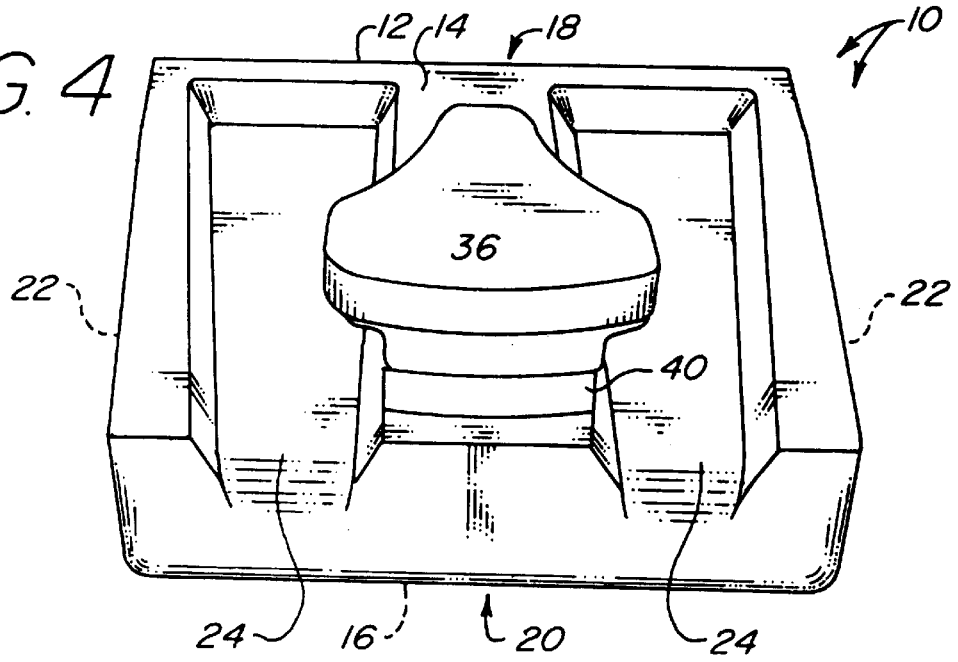
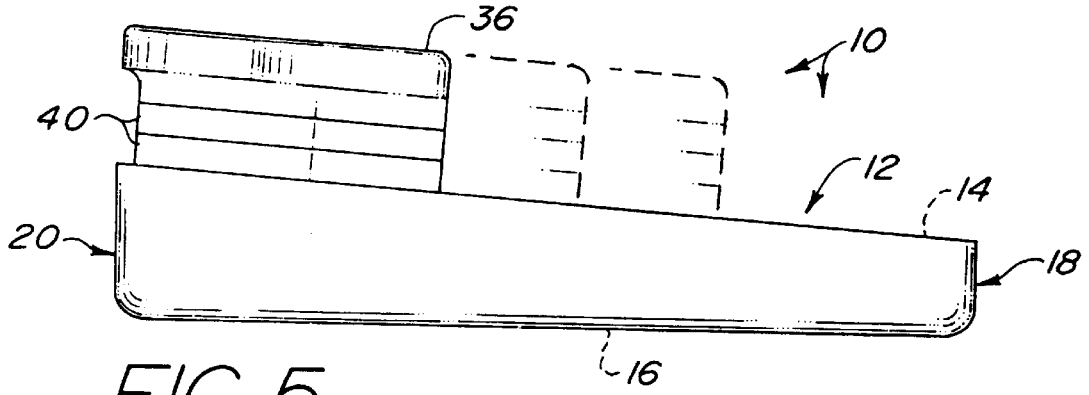
FIG. 5
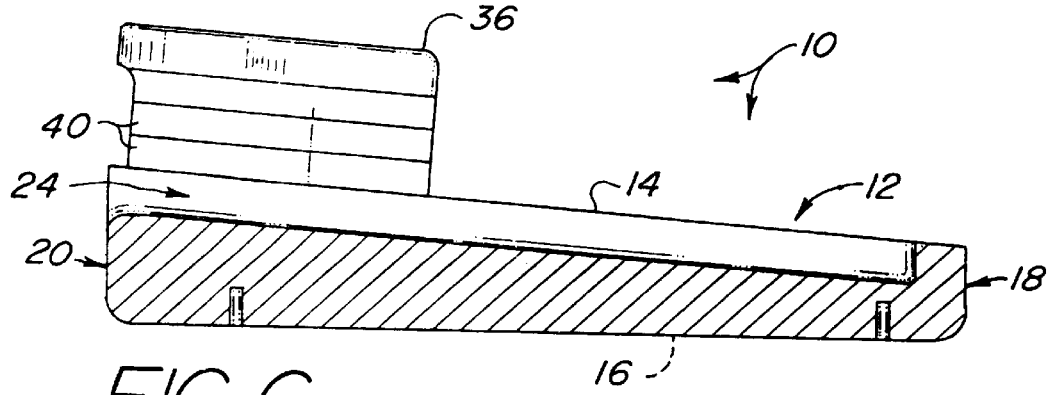
FIG. 6

KNEELER

This application is a continuation-in-part of patent application Ser. No. 08/675,544 filed Jul. 3, 1996 now abandoned.

BACKGROUND OF THE INVENTION

1. Field of the Invention

The present invention relates to a device for providing user comfort in a kneeling position.

2. Background of the Prior Art

Working on cars, washing children in a bath tub, and working in the garden are but a few examples of endeavors that require a person to be in a kneeling position, sometimes for extended periods of time. Kneeling, especially prolonged kneeling, can result in pressure buildup and subsequent pain and stiffness in the knees, legs, thighs and back. In extreme situations, medical attention is required. As a result of the discomfort in the knees, legs, thighs and back, individuals will refrain from activities that place pressure and stress onto these areas, resulting in necessary chores being avoided.

Devices have been proposed for assisting individuals whose activities involve kneeling. These devices either cushion the knees or legs, or remove pressure from the knees altogether. Although the devices found in the art working with varying degrees of success, they suffer from one of two major maladies.

First, many devices, although greatly reliving or completely eliminating pressure on the knees, give the user limited mobility and thus limited utility. Second, other devices, although providing a high level of user comfort and mobility, are relatively complex to manufacture and, as a result, are expensive to buy and maintain.

Furthermore, none of these devices give the user the ability to sit while in a kneeling position, thereby reducing or eliminating unwanted stress on the lower body.

Therefore, there is a need in the art for a device for relieving pressure from an individual's knees, legs, thighs and back whenever the individual is performing a task in a kneeling position. Such as device must provide a high degree of user comfort by placing the user's weight onto the buttocks, yet must give the user a high level of mobility and versatility. This must be accomplished irrespective of a person's size. Such a device must be of simple and straightforward construction.

SUMMARY OF THE INVENTION

The kneeler of the present invention meets the aforementioned needs in the art. The kneeler provides a device for receiving and cushioning a user's knees and legs whenever the user kneels as well as provides a seat in order to place the user's weight onto the buttocks.

The kneeler is comprised of a generally rectangular body member. A pair of troughs coextend from the back of the body toward the front terminating prior to the front. Optional knee wells are locatable at the ends of the troughs distant from the back of the device. A pair of runners are removably securable to the bottom of the body member. A seat is removably securable to the top of the body member and is selectively positionable along the length of the body member. The seat can have optional risers interspaced between it and the body. An opening on the front of the body member acts as a receptacle for small objects.

The device, which can be constructed as a single piece integral unit of soft resilient material, provides a high level of user comfort without restricting either device or user mobility. The device is designed to be used by persons of varying height. The device is of very simple design and construction and can be quickly and easily transported.

BRIEF DESCRIPTION OF THE DRAWINGS

FIG. 4 is a back elevation view of the kneeler.

FIG. 5 is a side elevation of the kneeler with the various positions of the seat in outline.

FIG. 6 is a cutaway view of the kneeler.

Similar reference numerals refer to similar parts throughout the several views of the drawings.

DETAILED DESCRIPTION OF THE PREFERRED EMBODIMENT

Figure 1:
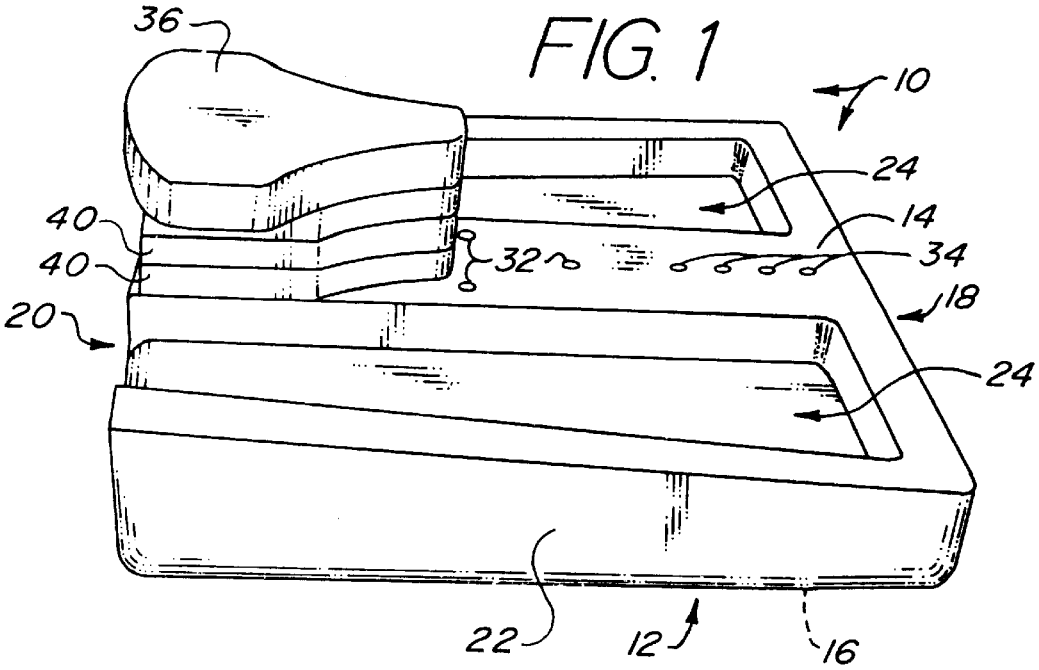
FIG. 1 is an isometric view of the kneeler of the present invention.
Figure 3:
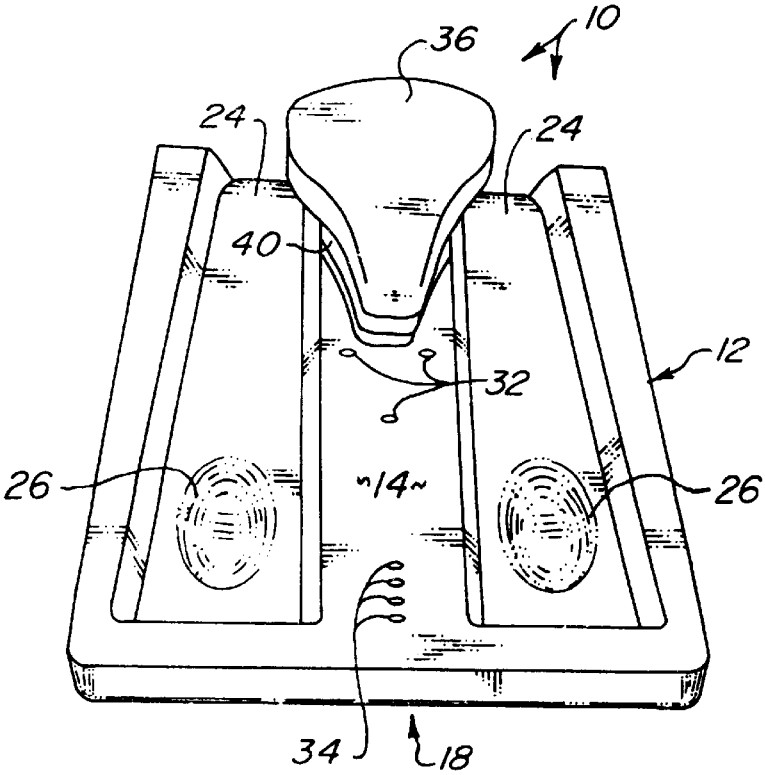
FIG. 3 is a front elevation view of the kneeler.

Referring now to the drawings, it is seen that the kneeler of the present invention, generally denoted by reference numeral 10, is comprised of a generally rectangular base 12, having a top surface 14, a bottom surface 16, and a front 18 and a back 20 joined by coextensive sides 22. The top surface 14 may slope downwardly from the back 20 to the front 18. If desired, the back 20 may be tapered, as seen in FIG. 4.

A pair of coextensive troughs 24 extend from the back 20 and terminate prior to the front 18. If desired, the troughs 24 can slope downwardly from the back 20 toward the front 18. If further desired, a well 26 can be located at the end of each trough 24 distant from the back 20.

The troughs 24, the wells 26 if used, and the back 20 are all cushioned for a high level of user comfort. Advantageously, the device 10 can be an integral unit constructed from a relatively soft resilient material such as closed cell foam.

Figure 2:
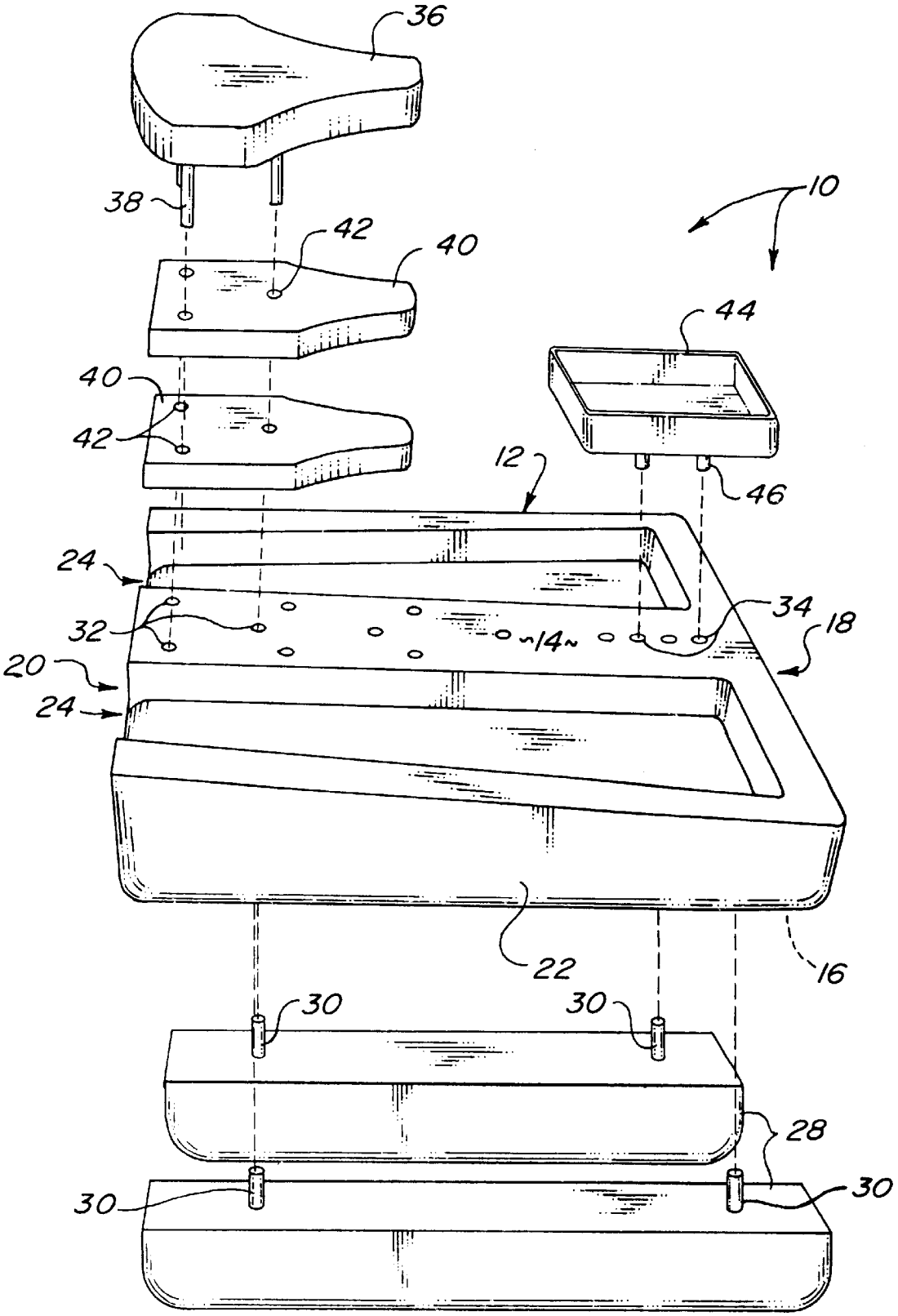
FIG. 2 is an exploded view of the kneeler.

Two sets of apertures (one set illustrated in FIG. 6) are located on the bottom surface 16. As seen in FIG. 2, a pair of runners 28 each have a pair of elongate body members and a pair of upwardly oriented prongs 30. Each pair of prongs 30 is registerable with and receivable within one of the two sets of apertures located on the bottom surface 16, allowing the runners 28 to be removably secured to the kneeler 10, in order to give the kneeler 10 a rise in height as desired.

A plurality of first apertures 32 is located on the top surface 14, proximate the back 20 and extending toward the front 18, between the troughs 24, while an opening 34 is located on the top surface 14 beyond the first plurality of apertures 32. The opening 34 acts as a receptacle for holding objects.

As seen in FIG. 2, a seat 36 of any appropriate shape and design has a prong 38 extending downwardly. The prong 38 is registerable with and receivable within one of the first apertures 32 for removably securing a seat to the kneeler 10. At least one riser 40, in generally similar shape to the shape of the seat 36, has an opening 42 located thereon. The opening 42 of the riser 40 permits the riser to pass along the same prong 38 of which the seat 36 passes to give the seat 36 greater elevation. As a plurality of first aperture sets 32 exist, the seat 36 can be selectively placed in one of several positions. A relatively tall person may position the seat 36 relatively close to the back 20 (by registering the prong 38 of the seat 36 with the first aperture 32 that is closest to the back 20), while a shorter person would position the seat 36 closer toward the front 18. As seen in FIG. 2, an optional opening 44 may be located on each side 22 for receiving the risers 42 therein for easy and convenient storage of the risers 42 when not in use.

In order to utilize the kneeler 10 of the present invention, the user secures the runners 28 to the device 10, if desired. If also desired, a seat 36 is secured to the device 10, with one or more risers 40 being utilized, as needed. The user places his knees in the fronts of the troughs 24 (into the wells 26 if used), with the legs extending along the length of the troughs 24. The tops of the user's feet abut the back 20. The user then goes about the chore at hand.

While the invention has been particularly shown and described with reference to an embodiment thereof, it will be appreciated by those skilled in the art that various changes in form and detail may be made without departing from the spirit and scope of the invention.

I claim:

1. A kneeler comprising:

a generally solid rectangular body having a top surface, a bottom surface, and a front and a back joined by a pair of coextensive sides;

a pair of coextensive troughs, disposed within and passing through the top surface, extending from the back and terminating prior to the front;

a seat extending upwardly from the top surface;

at least one first aperture set located within the top surface;

a prong extending downwardly from the seat and registerable with and receivable within the at least one first aperture set; and at least one riser having a first opening such that the at least one riser is positioned between the seat and the body and the prong is registerable with and receivable through the first opening.

2. The kneeler as in claim 1 further comprising a pair of wells, one well each disposed within an end of each trough distant the back.

3. The kneeler as in claim 2 wherein the troughs and the wells are cushioned.

4. The kneeler as in claim 1 further comprising:

a pair of aperture sets located on the bottom surface; and a pair of runners, each having a pair of prongs extending upwardly, registering with and received within one of the pair of aperture sets.

5. The kneeler as in claim 1 further comprising an opening on each of the sides for removably receiving the at least one riser.

6. The kneeler as in claim 1 wherein the troughs are cushioned.

7. The kneeler as in claim 1 wherein the device is an integral unit constructed from a resilient material.

8. The kneeler as in claim 1 wherein the top surface slopes downwardly from the back to the front.

* * * * *